US012043446B2

(12) United States Patent
Wang

(10) Patent No.: US 12,043,446 B2
(45) Date of Patent: Jul. 23, 2024

(54) BOTTLE WITH ANTI-SCALD HANDLE

(71) Applicant: Shen Zhen Xin Yue Tang Plastic & Hardware Co., Ltd, Shenzhen (CN)

(72) Inventor: Chunlei Wang, Shenzhen (CN)

(73) Assignee: SHEN ZHEN XIN YUE TANG PLASTIC & HARDWARE CO., LTD, Shenzhen (CN)

( * ) Notice: Subject to any disclaimer, the term of this patent is extended or adjusted under 35 U.S.C. 154(b) by 224 days.

(21) Appl. No.: 17/654,403

(22) Filed: Mar. 11, 2022

(65) Prior Publication Data

US 2023/0286699 A1 Sep. 14, 2023

(51) Int. Cl.
*B65D 23/10* (2006.01)

(52) U.S. Cl.
CPC ..... *B65D 23/104* (2013.01)

(58) Field of Classification Search
CPC ..... B65D 23/10; B65D 23/102; B65D 23/104
See application file for complete search history.

(56) References Cited

U.S. PATENT DOCUMENTS

| | | | | | |
|---|---|---|---|---|---|
| 6,079,591 | A * | 6/2000 | Timms | B65D 23/102 220/592.2 |
| D893,956 | S * | 8/2020 | Wang | D9/531 |
| 2018/0170616 | A1* | 6/2018 | Usami | B29C 49/30 |
| 2020/0198838 | A1* | 6/2020 | Leblanc | B65D 23/104 |
| 2021/0122526 | A1* | 4/2021 | Sohel | B65D 23/106 |

FOREIGN PATENT DOCUMENTS

| | | | | |
|---|---|---|---|---|
| KR | 20070091770 | * | 9/2007 | B65D 23/104 |
| KR | 20100087538 | * | 8/2010 | B65D 23/104 |
| KR | 20140119574 | * | 10/2014 | B65D 23/104 |
| WO | WO2012052837 | * | 4/2012 | B65D 23/104 |

* cited by examiner

*Primary Examiner* — J C Jacyna
(74) *Attorney, Agent, or Firm* — Bayramoglu Law Offices LLC

(57) ABSTRACT

A bottle with an anti-scald handle is provided, including a bottle body internally provided with a cavity and a handheld portion independent of the bottle body, and the handheld portion is an interlayer structure internally provided with a cavity; an inward sunken space area is provided on the bottle body; a height of the handheld portion matches the space area, and when being placed in the space area, the handheld portion is fixed with the bottle body to form a handle of the bottle. On the premise of not changing the overall shape of the bottle, the handle portion is redesigned to make the handle have an anti-scald function and solve the problem of inconvenience to clean.

10 Claims, 4 Drawing Sheets

BOTTLE WITH ANTI-SCALD HANDLE

TECHNICAL FIELD

The present invention relates to a bottle, and particularly relates to a bottle with an anti-scald handle.

BACKGROUND

In the existing bottles with an integrated handle, the inner cavity of the handle and the water-holding cavity of the bottle typically communicate. That is, when the bottle is filled with hot water, the handle portion is heated and inconvenient to hold. Furthermore, impurities left in the inner cavity of the handle may cause inconvenience to clean.

SUMMARY

To overcome the shortcomings of the prior art, the present invention provides a bottle with an anti-scald handle. Without changing the overall shape of the bottle, the handle portion is redesigned to make the handle has an anti-scald function and to solve the problem of inconvenience during the cleaning.

A bottle with an anti-scald handle includes a bottle body internally provided with a cavity and a handheld portion independent of the bottle body, and the handheld portion has an interlayer structure internally provided with a cavity; an inward sunken space area is provided on the bottle body; a height of the handheld portion matches the space area, and when being placed in the space area, the handheld portion is fixed with the bottle body to form a handle of the bottle.

Optionally, the handheld portion includes a first handheld portion and a second handheld portion, and the first handheld portion and the second handheld portion are clamped together.

Optionally, an inside of the first handheld portion is provided with a plurality of preset positioning holes, and an inside of the second handheld portion is provided with positioning columns that match the number and position of the positioning holes.

Optionally, a position of a surface of the bottle body adjacent to the space area is provided with an injection hole, and the injection hole is used for fixing the handheld portion.

Optionally, the injection hole includes a preset number of notches, and the handheld portion is provided with clamping slots matching the notches.

Optionally, the first handheld portion and the second handheld portion are provided with side grooves to be oppositely connected, respectively.

Optionally, the bottle body is overall cylindrical.

Optionally, a surface of the bottle body has at least one flat section.

The bottle with an anti-scald handle provided by the present invention has a bottle body internally provided with a cavity and a handheld portion, and the bottle body and the handheld portion are two independent structural members, where an inward sunken space area is provided on the bottle body for holding water, and the space area is reserved for holding by hand. The height of the handheld portion matches the space area, so it is convenient to place the handheld portion into the space area to integrate with the bottle body by various methods to form a handle of the bottle. For users, the handle can be used as an undetachable structure or a detachable structure after the bottle is off the assembly line. Since the handheld portion is an interlayer structure internally provided with a cavity, the interlayer structure can play the role of thermal insulation. Moreover, the handle is no longer communicated with the inner cavity of the bottle, which can further play the effect of heat insulation and anti-scald, and avoid the inconvenience to clean the inner cavity of the handle.

Figure 1:
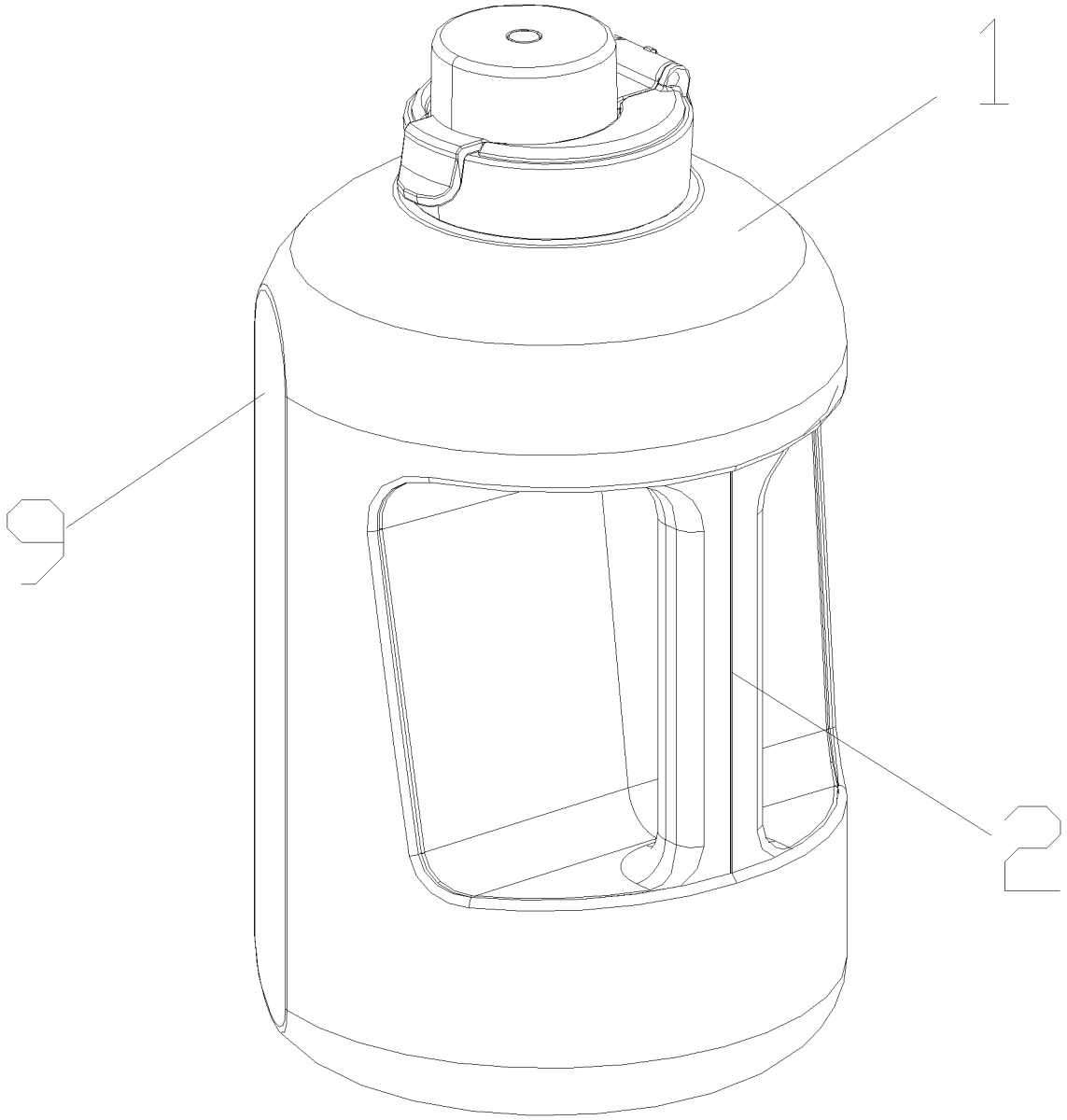
FIG. 1 is a perspective view of a bottle with an anti-scald handle in an embodiment of the present invention.

The reference numbers in the drawings of the specification are as follows:

1, bottle body; 2, handheld portion; 21, first handheld portion; 22, second handheld portion; 3, space area; 4, cavity; 5, positioning hole; 6, positioning column; 7, notch, 8, clamping slot; 9, flat section; 10, side groove.

DETAILED DESCRIPTION OF THE EMBODIMENTS

To make the technical problems to be solved, technical solutions and advantages of the present invention clearer, in combination with drawings and embodiments below, the present invention is further explained in detail. It should be understood that the specific embodiments described herein are used only to explain the present invention and are not used to limit the present invention.

Figure 2:
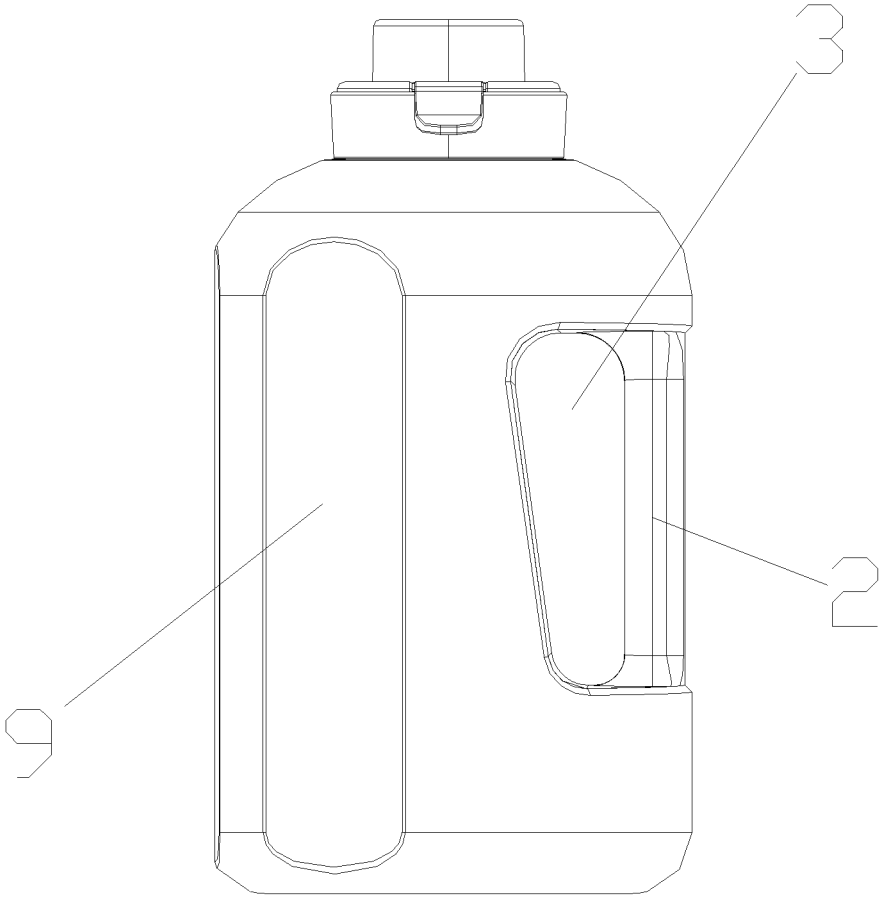
FIG. 2 is a lateral view of the bottle with the anti-scald handle in an embodiment of the present invention.
Figure 3:
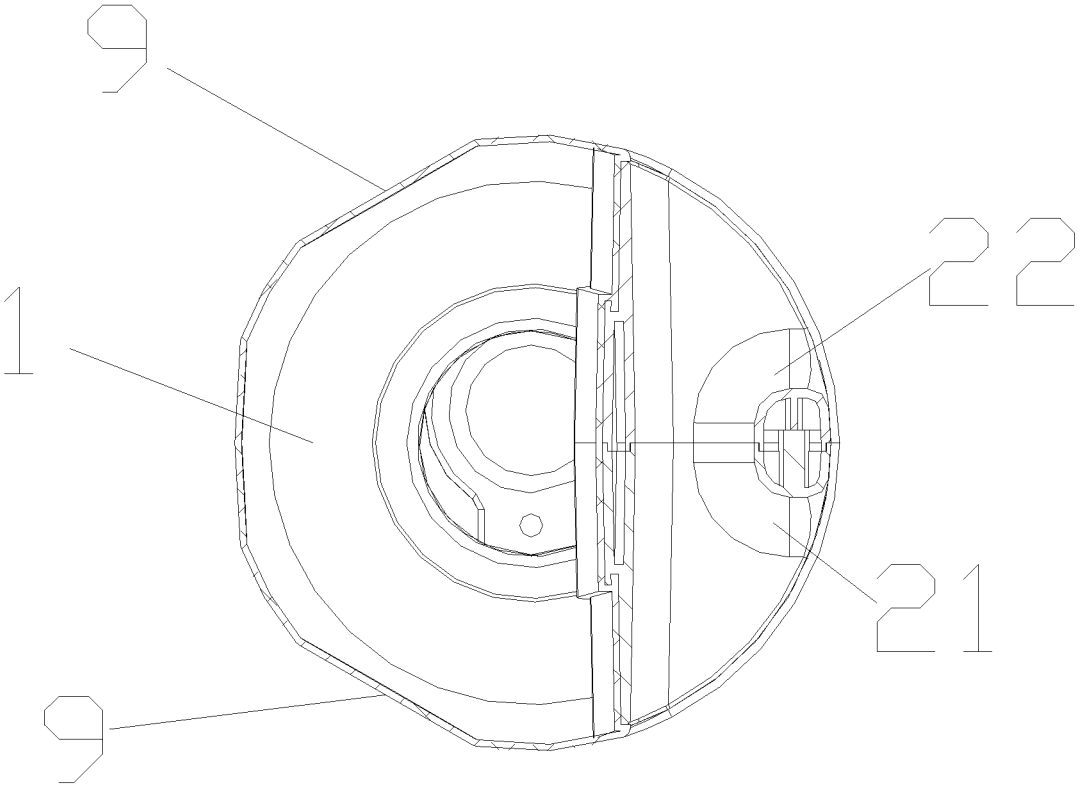
FIG. 3 is a top view of the bottle with the anti-scald handle in an embodiment of the present invention.
Figure 4:
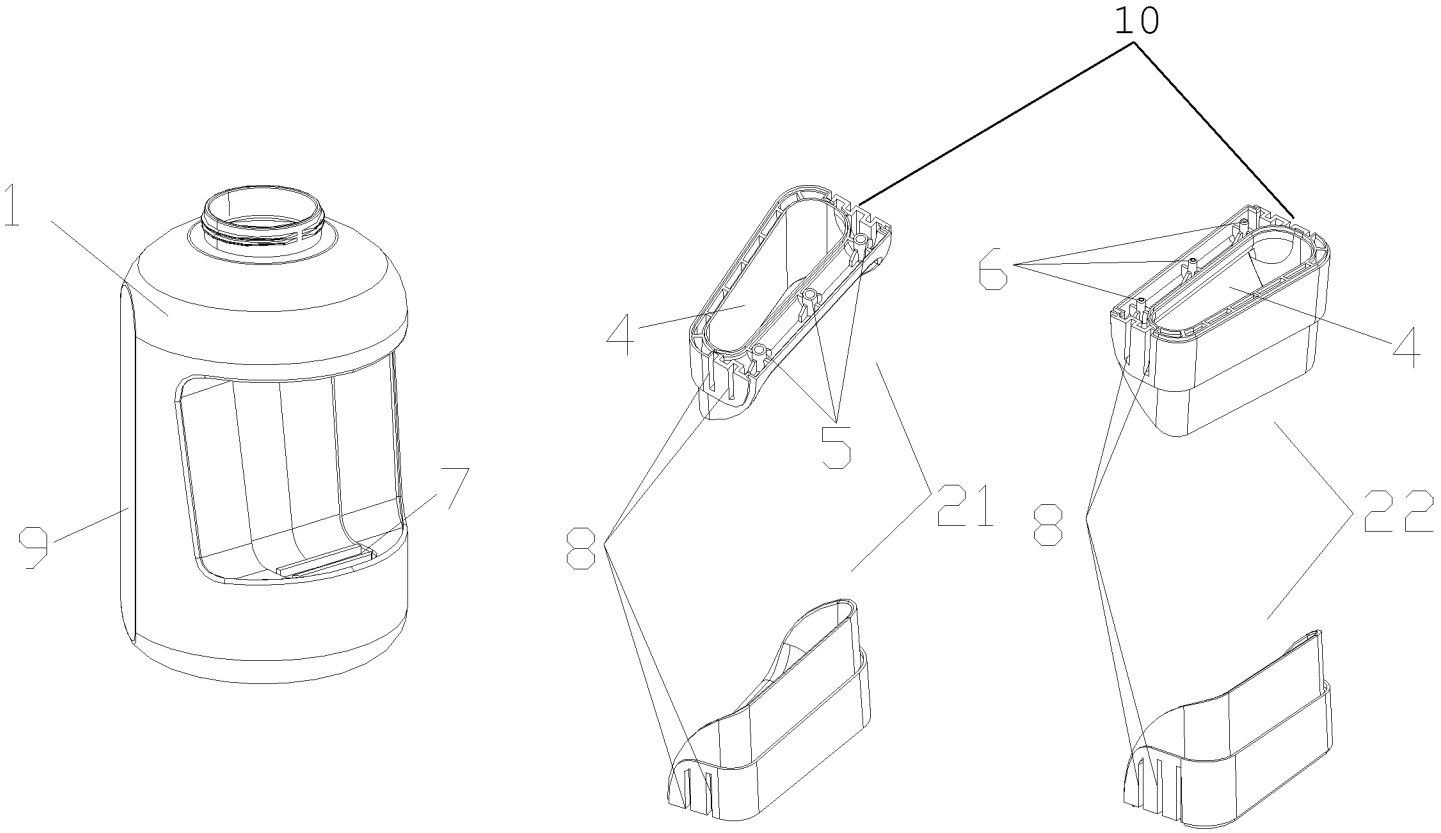
FIG. 4 is a structural decomposition view of the bottle with the anti-scald handle in an embodiment of the present invention.

A bottle with an anti-scald handle, as shown in FIGS. 1 to 3, includes the bottle body 1 internally provided with the cavity 4 and the handheld portion 2 independent of the bottle body, and the handheld portion is an interlayer internally provided with the cavity 4; the inward sunken space area 3 is provided on the bottle body; the height of the handheld portion matches the space area, and when being placed in the space area, the handheld portion is fixed with the bottle body to form a handle of the bottle.

Specifically, the bottle body and the handheld portion are two independent structural members, which avoids the problem of the communication between the cavity of the handle and the cavity of the bottle in the category of the bottle. The space area sunken to the inside of the bottle on the bottle body is used to reserve a space for holding the handle of the bottle by hand. Meanwhile, the height of the handheld portion matches the space area, so that it is convenient to fix the handheld portion with the bottle body by various methods, such as injection molding, glue fixation, clamping and the like. The interlayer structure of the handheld portion can play the role of thermal insulation to further reduce the heat transferred in the bottle.

Further, in one embodiment, the handheld portion includes the first handheld portion 21 and the second handheld portion 22, and the first handheld portion and the second handheld portion are clamped together. That is, the handheld portion can be a single structure, and be also a structure formed by splicing a plurality of structural members. When the handheld portion is formed by splicing two bilaterally symmetrical structural members, it is more convenient for production and assembly. Preferably, the inside of the first handheld portion is provided with a plurality of preset positioning holes 5, and the inside of the second handheld portion is provided with positioning columns 6 that match the number and position of the positioning holes. Through the mutual clamping of the positioning holes and the positioning columns, the first handheld portion and the second handheld portion can be simply and efficiently spliced together, and then to fix the first handheld portion and the second handheld portion by ultrasonic technology or glue.

Further, in one embodiment, the position of the surface of the bottle body adjacent to the space area is provided with an injection hole, and the injection hole is used for fixing the handheld portion; preferably, the injection hole includes the preset number of notches 7, and the handheld portion is provided with the clamping slots matching the notches; the first handheld portion and the second handheld portion are provided with the side grooves 10 to be oppositely connected, respectively.

Specifically, the handheld portion is first modeled by injection molding and the notches and the clamping slots can be glued by glue or connected by ultrasonic; or the handheld portion is placed in another set of bottle body mold, and in the injection molding process of the bottle body mold, the bottle body are molded and the plastic enters the clamping slots 8 and the side grooves 10 to achieve the fixing between the handheld portion and the bottle body.

The handheld portion and the bottle body can also be connected by other methods, so that users can disassemble and replace by themselves.

Further, in one embodiment, the bottle body is overall cylindrical, that is, when the handheld portion is integrated with the bottle body, the inward sunken space area provided on the bottle body is inside the bottle body, so that the handle does not protrude outward and occupy an additional space, which is more convenient for the storage of the bottle. The bottle body may not be limited to a cylindrical shape, as long as being the shape where the handheld portion does not protrude from the bottle.

Further, in one embodiment, the surface of the bottle body has at least one flat section 9, which can outwards provide an additional grip area.

The above is a description of the bottle with the anti-scald handle of the present invention, which is used for assisting to understand the present invention; whereas, the embodiments of the present invention are not limited by the above embodiment, and any change, modification, substitution, combination and simplification made under the principle of the present invention shall be an equivalent replacement mode and shall be included in the protection scope of the present invention.

What is claimed is:

1. A bottle with an anti-scald handle, comprising a bottle body internally provided with a first cavity and a handheld portion independent of the bottle body, and the handheld portion is an interlayer structure internally provided with a second cavity;

an inward sunken space area is provided on the bottle body; and a height of the handheld portion matches a height of the inward sunken space area, and when the handheld portion is placed in the inward sunken space area, the handheld portion is fixed with the bottle body to form a handle of the bottle, wherein the handheld portion comprises a first handheld portion and a second handheld portion, and the first handheld portion and the second handheld portion are clamped together, and wherein an inside of the first handheld portion is provided with a plurality of preset positioning holes, and an inside of the second handheld portion is provided with positioning columns, the positioning columns match a number and position of the plurality of preset positioning holes.

2. The bottle with the anti-scald handle according to claim 1, wherein a position of a surface of the bottle body adjacent to the inward sunken space area is provided with an injection hole, and the injection hole is configured for fixing the handheld portion.

3. The bottle with the anti-scald handle according to claim 2, wherein the injection hole comprises a preset number of notches, the handheld portion is provided with clamping slots, and the clamping slots match the preset number of notches.

4. The bottle with the anti-scald handle according to claim 1, wherein the first handheld portion and the second handheld portion are provided with side grooves to be oppositely connected, respectively.

5. The bottle with the anti-scald handle according to claim 1, wherein the bottle body is overall cylindrical.

6. The bottle with the anti-scald handle according to claim 5, wherein a surface of the bottle body has at least one flat section.

7. The bottle with the anti-scald handle according to claim 1, wherein the bottle body is overall cylindrical.

8. The bottle with the anti-scald handle according to claim 2, wherein the bottle body is overall cylindrical.

9. The bottle with the anti-scald handle according to claim 3, wherein the bottle body is overall cylindrical.

10. The bottle with the anti-scald handle according to claim 4, wherein the bottle body is overall cylindrical.

* * * * *